US009683202B2

(12) United States Patent
Lu et al.

(10) Patent No.: US 9,683,202 B2
(45) Date of Patent: Jun. 20, 2017

(54) SOFTENER COMPOSITION

(71) Applicant: Everlight Chemical Industrial Corporation, Taipei (TW)

(72) Inventors: Mei-Ting Lu, Taoyuan County (TW); Tzu-Heng Ko, Taoyuan County (TW); Yuan-Pin Pan, Taoyuan County (TW); Der-Gun Chou, Taoyuan County (TW); Shu-Chu Chou, Taoyuan County (TW)

(73) Assignee: EVERLIGHT CHEMICAL INDUSTRIAL CORPORATION (TW)

( * ) Notice: Subject to any disclaimer, the term of this patent is extended or adjusted under 35 U.S.C. 154(b) by 16 days.

(21) Appl. No.: 14/822,989

(22) Filed: Aug. 11, 2015

(65) Prior Publication Data

US 2016/0060580 A1 Mar. 3, 2016

(30) Foreign Application Priority Data

Sep. 2, 2014 (TW) ..... 103130226 A

(51) Int. Cl.

| | |
|---|---|
| ***C11D 3/37*** | (2006.01) |
| ***C11D 3/00*** | (2006.01) |
| ***C11D 1/62*** | (2006.01) |
| ***C11D 3/42*** | (2006.01) |

(52) U.S. Cl.

CPC ..... *C11D 3/3726* (2013.01); *C11D 1/62* (2013.01); *C11D 3/001* (2013.01); *C11D 3/0005* (2013.01); *C11D 3/42* (2013.01)

(58) Field of Classification Search

CPC ..... C11D 3/3726

See application file for complete search history.

(56) References Cited

U.S. PATENT DOCUMENTS

| | | | | |
|---|---|---|---|---|
| 5,407,588 A * | 4/1995 | Butterworth | C11D 1/62 | 510/524 |
| 5,672,398 A * | 9/1997 | Johnson | F16L 55/1656 | 138/137 |
| 2013/0067664 A1* | 3/2013 | Lu | C07D 403/14 | 8/552 |

FOREIGN PATENT DOCUMENTS

CN 1500138 A 5/2004

* cited by examiner

*Primary Examiner* — John Hardee

(74) *Attorney, Agent, or Firm* — Bacon & Thomas, PLLC

(57) ABSTRACT

The present invention provides a softener composition, which attaches onto the fabric during the rinsing process, and thus enables the fabric to have the anti-ultraviolet function. The softener composition comprises (A) 0.05 to 50 wt % of polyurethane-based polymeric UV light absorber, (B) 2 to 15 wt % of cationic softener, and (C) 35 to 97 wt % of water.

11 Claims, No Drawings

SOFTENER COMPOSITION

CROSS REFERENCE TO RELATED APPLICATION

This application claims the benefits of the Taiwan Patent Application Serial Number 103130226, filed on Sep. 2, 2014, the subject matter of which is incorporated herein by reference.

BACKGROUND OF THE INVENTION

1. Field of the Invention

The present invention relates to a softener composition, and, particularly, to a softener composition having an excellent anti-ultraviolet function.

2. Description of Related Art

Due to the gradual destruction of the ozone layer, the intensity of of the ultraviolet (UV) rays of sunlight, including UVB rays with wavelengths of 280 to 320 nanometers (nm) and UV-A rays with wavelengths of 320 to 400 nm, is increasing. Exposure to sunlight can easily lead to erythema, skin burning and turning dark, skin damage, loss of skin elasticity, skin wrinkles, and even skin cancer. Therefore, in order to protect skin from the damage by sunlight, common methods are to apply sunscreen directly to the exposed skin or to use fabric (such as parasols, clothing, etc.) to shield off the sunlight.

However, most natural or synthetic fabrics cannot effectively or completely block UV rays. Accordingly, it is possible that skin is not effectively protected by using fabrics to block the sunlight radiation, and skin damage would very likely occur. For this reason, many methods used to improve the anti-ultraviolet ray function of fabrics have been reported.

For example, as disclosed by Taiwan Patent Application Publication No. 200804196, a solution of ZnO or $TiO_2$ capable of absorbing UV light is used to treat clothing; and as disclosed by U.S. Pat. No. 6,174,854B1, an organic small molecular UV light absorber is added into a clothing softener, where when fabrics are rinsed with the softener, the organic molecular UV light absorber attaches onto the fabrics.

However, the UV light absorber used in the aforesaid method has a molecular weight that is too small to stay stably attached onto the fabrics. Consequently, the UV light absorber detaches easily and the function of UV light absorption is decreased. Thus, the UV light absorber has rather poor tolerance to washing. The UV light absorption ability of the fabrics cannot be effectively maintained.

SUMMARY OF THE INVENTION

In view of the above, a softener composition added with a polyurethane-based polymeric UV light absorber is provided in the present invention. Because the UV light absorber is a polyurethane-based polymer, it may attach securely onto fabric fibers, so that the fabric has a more lasting anti-UV function to prevent organisms from UV damage.

A main object of the present invention is to provide a softener composition, which attaches onto a fabric in a rinsing process to enable the fabric to have an anti-ultraviolet function, so that when the fabric is used to block sunlight, it may effectively absorb UV light.

In order to achieve the aforesaid object, the softener composition provided in the present invention may include: (A) 0.05 to 50 percent by weight (wt %) of polyurethane-based polymeric UV light absorber; (B) 2 to 15 wt % of cationic softener; and (C) 35 to 97 wt % of water.

In a preferred embodiment of the present invention, the containing amount of the polyurethane-based polymeric UV light absorber may be preferably from 0.1 to 20 wt %, and the containing amount of the cationic softener may be preferably from 3 to 10 wt %.

According to a preferred embodiment of the present invention, the polyurethane-based polymeric UV light absorber may be represented by formula (I):

(I)

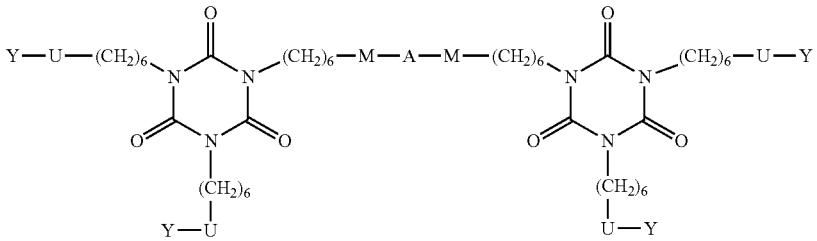

in which A may be selected from the group consisting of the following:

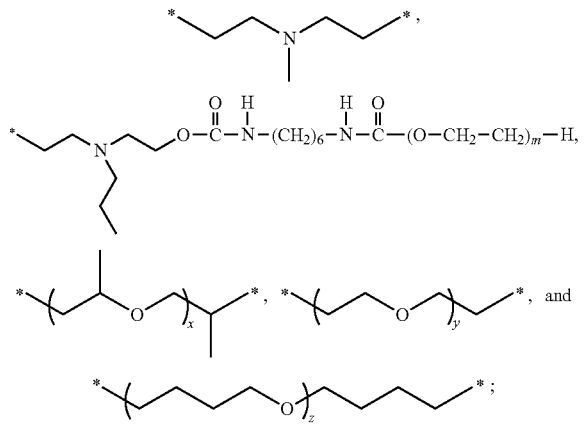

in which, x may be an integer of 15 to 20, y may be an integer of 20 to 50, z may be an integer of 10 to 15, in may be an integer of 15 to 20, * is a site for bonding to M, each of M and U may be —NHCOO; and Y may be selected from the group consisting of the following:

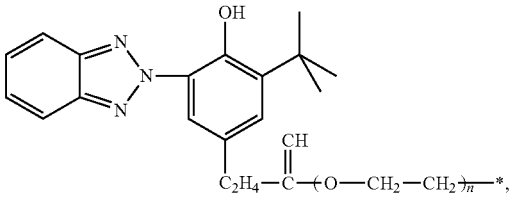

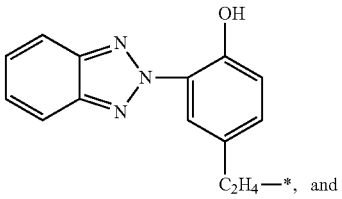

and

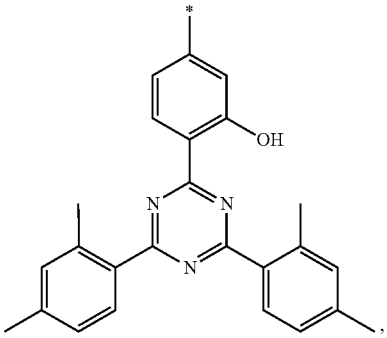

in which n may be an integer of 5 to 10.

In a more preferred embodiment of the present invention, Y in the polyurethane-based polymeric UV light absorber is preferably represented by the following:

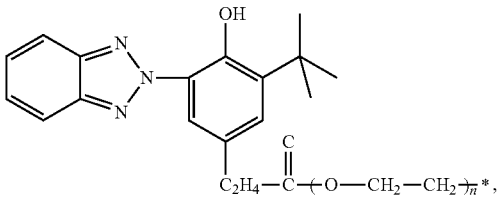

wherein n may be an integer of 5 to 10. In this instance, A is preferably

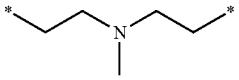

or

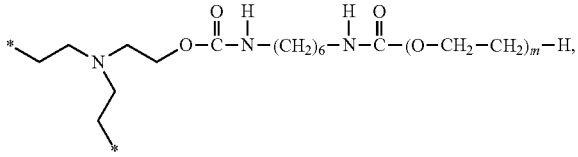

in which in is an integer of 15 to 20, and the polyurethane-based polymeric UV light absorber is a cationic polyurethane-based polymeric UV light absorber.

Furthermore, when Y is represented by the following:

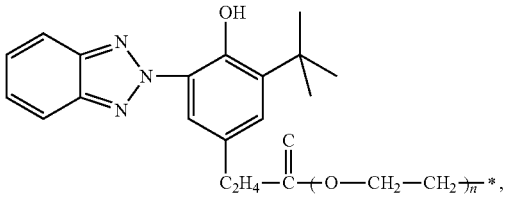

in which n may be an integer of 5 to 10, A is preferably

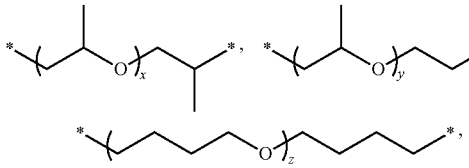

in which, x is an integer of 15 to 20, y is an integer of 20 to 50, and z is an integer of 10 to 15, and, in this situation, the polyurethane-based polymeric UV light absorber is a nonionic polyurethane-based polymeric UV light absorber. The aforesaid cationic and nonionic polyurethane-based polymeric UV light absorbers are relatively compatible with the cationic softener and stable.

In a preferred embodiment of the present invention, the polyurethane-based polymeric UV light absorber is represented by formula (II) or (III):

II
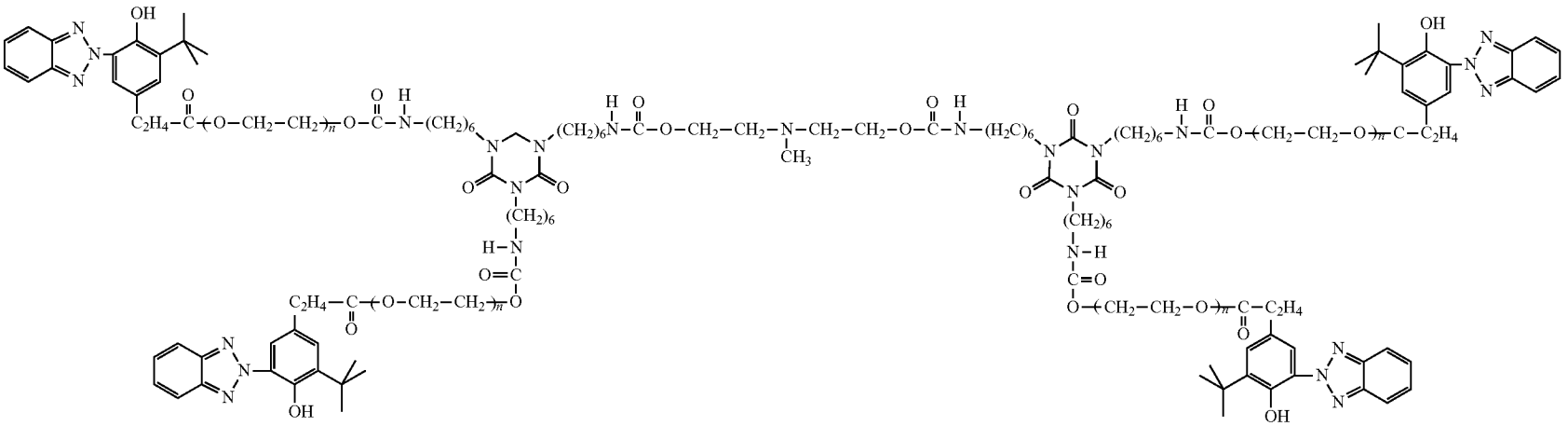
III
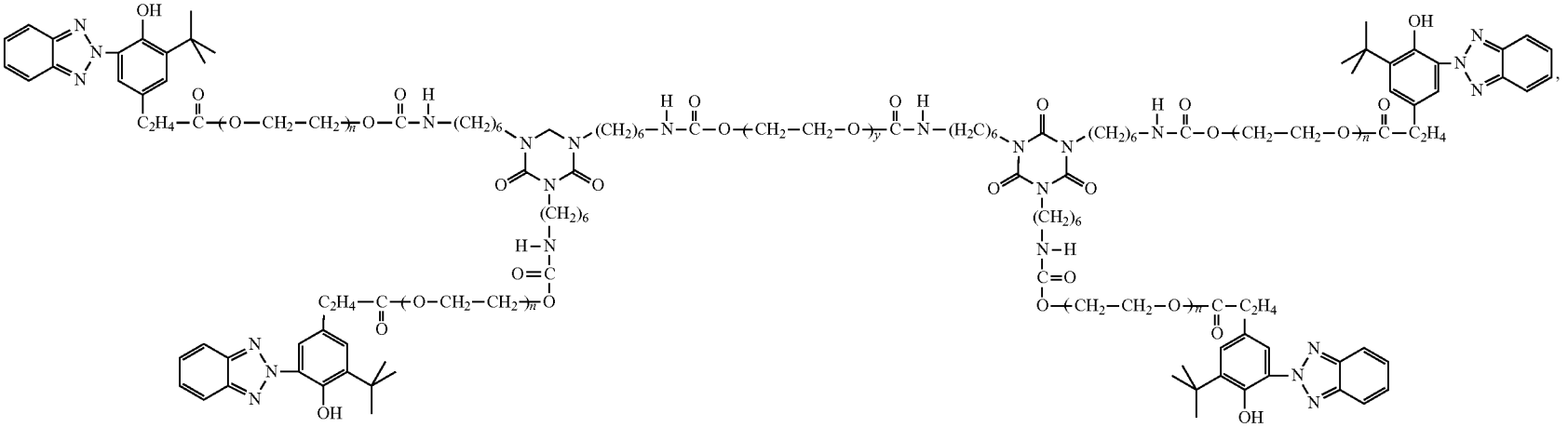

in which, n is an integer of 5 to 10, and y is an integer of 20 to 50.

Furthermore, the cationic softener used in the present invention may be any cationic softener known in the art without particular limitations; however, preferably, it comprises at least a quaternary ammonium salt compound. The quaternary ammonium salt compound may be preferably selected from the group consisting of cationic quaternary ammonium salts, cyclic quaternary ammonium salts of the imidazolinium type, diamido quaternary ammonium salts, biodegradable quaternary ammonium salts, and a combination thereof. The quaternary ammonium salt serving as the cationic softener may be a salt such as sulfate, methyl sulfate, ethyl sulfate, bromide, hydroxide, and the like.

Furthermore, the cationic softener used in a preferred embodiment of the present invention is preferably a cyclic quaternary ammonium salt of the imidazolinium type. The preferred cyclic quaternary ammonium salt of the imidazolinium type is represented by formula (IV):

(IV)

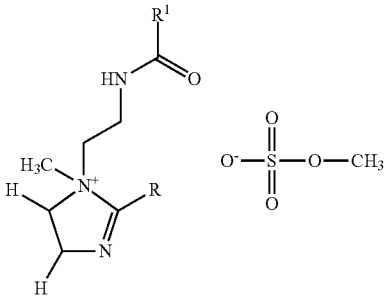

in which each of R and R' is a tallow alkyl group. In addition, the cyclic quaternary ammonium salt of the imidazolinium type may be a salt such as sulfate, methyl sulfate, ethyl sulfate, bromide, hydroxide, and the like, too.

The softener composition provided in the present invention is mainly applied to fabrics to improve the UV absorption ability of the fabrics for functioning sun protection. The softener composition of the present invention may be applied to various fabrics without particular limitations. For example, the fabrics may be made of natural fibers, such as cotton fibers, hemp fibers, flax fibers, wool fibers, rabbit hairs or the like, or synthetic fibers, such as viscose rayon fibers, polyester fibers, nylon fibers or the like. Furthermore, the softener composition is also applicable to a compound fabric, a combination fabric and the like having different fiber materials.

Furthermore, the softener composition is also applicable to various types of fabrics to achieve the UV absorption function without particular limitations. For example, it may be applied to home textiles, such as curtains, tablecloths and the like; vehicular fabrics, such as sunshades and the like; or various garments, all of which can improve the function of UV absorption by utilization of the softener composition of the present invention. In addition, since the softener composition provided in the present invention has an excellent function of UV absorption, it can be applied to agricultural fabrics requiring high ability of UV absorption for lastingly protecting crops against damage by strong sunlight.

Additionally, various additives may be added into the softener composition provided in the present invention as desired, and the types of additives are not particularly limited. The additives may be those conventionally added into softeners in the art, for example, perfume, dyes, bactericide, emulsifiers, whiteners, and so on. The containing amount of the additive can be as desired and depends on the conventional technology in the art without particular limitations.

Other objects, advantages, and novel features of the invention will become more apparent from the following detailed description

DETAILED DESCRIPTION OF THE PREFERRED EMBODIMENT

Preparation Example 1—Preparation Method of Compound (II)

55.67 g of EV80 (α-[3-[3-(2H-benzotriazol-2-yl)-5-(1,1-dimethylethyl)-4-hydroxyphenyl]-1-oxopropyl]-ω-hydroxypoly(oxo-1,2-ethanediyl) (Taiwan Everlight Chemical Industrial Corporation) was placed in a 125-ml separable reaction flask, stirred, heated to 50° C., and thereafter added with 22.20 g of THDI (1,3,5-tris(6-isocyanatohexyl)-1,3,5-triazinane-2,4,6-trione, Nippon Polyurethane Industry Co., Ltd. (NPU)) and 19.50 g of DMAc (N,N-dimethylacetamide). The mixture was heated to 90° C., and the reaction was performed for 2-3 hours (the NCO group was titrated till the end point of the reaction). Then, the mixture was cooled to 70° C., and 2.59 g of MDEA (N-methyldiethanolamine) neutralized by 1.30 g of AcOH (acetic acid) and 7.20 g of DMAc were then added. The mixture was heated to 90° C., and the reaction was performed for 2-3 hours (the NCO group was titrated till the end point of the reaction). Then, the mixture was cooled to 50° C., yielding the polyurethane-based polymeric UV light absorber represented by formula (II):

(II)

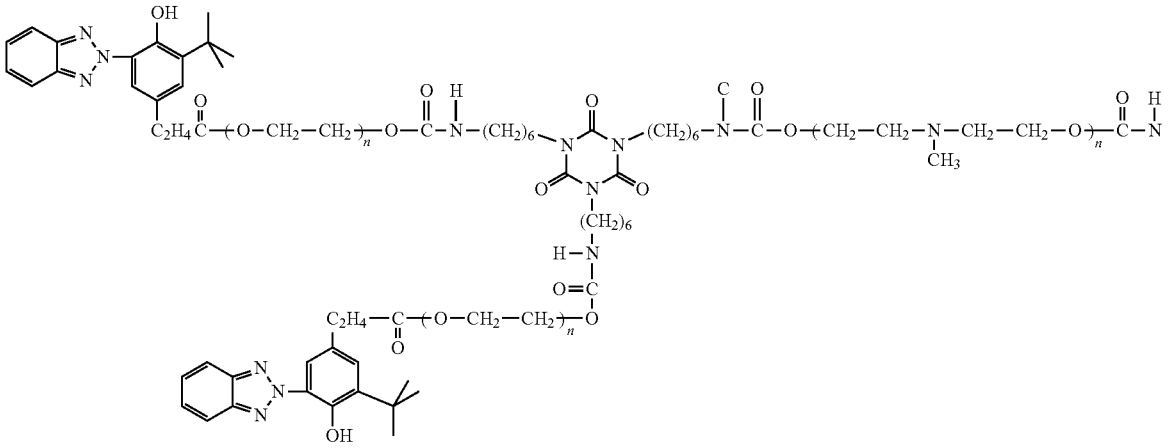

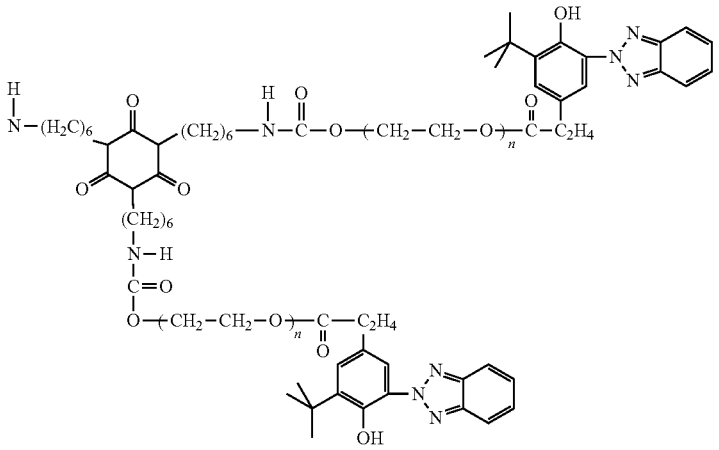

in which, n is an integer of 5 to 10.

Preparation Example 2—Preparation Method of Compound (III)

46.82 g of EV80 (α-[3-[3-(2H-benzotriazol-2-yl)-5-(1,1-dimethylethyl)-4-hydroxyphenyl]-1-oxopropyl]-ω-hydroxypoly(oxo-1,2-ethanediyl) (Taiwan Everlight Chemical Industrial Corporation) was placed in a 250-ml separable reaction flask, stirred, heated to 50° C., and added with 18.67 g of THDI (1,3,5-tris(6-isocyanatohexyl)-1,3,5-triazinane-2,4,6-trione, Nippon Polyurethane Industry Co., Ltd. (NPU)) and 16.40 g of DMAc (N,N-dimethylacetamide). The mixture was then heated to 90° C., and the reaction was performed for 2-3 hours (the NCO group was titrated till the end point of the reaction). Then, the mixture was cooled to 70° C., and then added with 11.30 g of DMAc and 18.00 g of PEG1000 (polyethylene glycol, Mw=1000). The mixture was heated to 90° C., and the reaction was performed for 2-3 hours (the NCO group was titrated till the end point of the reaction). Thereafter, the mixture was cooled to 50° C., yielding compound (III):

(III)

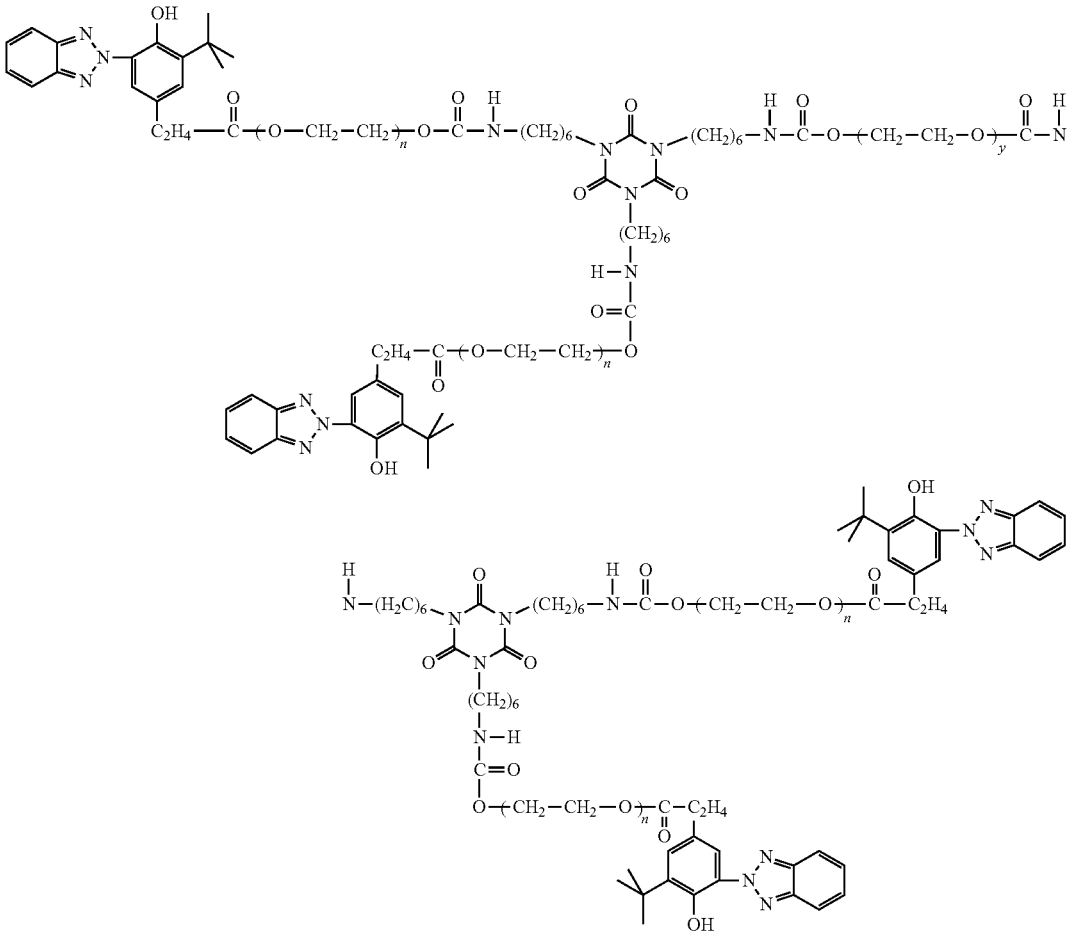

in which, n is an integer of 5 to 10, and y is an integer of 20 to 50.

EXAMPLE 1

In an environment of about 50° C., a mixed solution containing 0.1 wt % of polyurethane-based polymeric UV light absorber, 7.1 wt % of cyclic quaternary ammonium salt of the imidazolinium type (trade name: quaternary ammonium salt-27, commercially available from CHEMOS GmbH), and 92.8 wt % of deionized water was sufficiently stirred for 1 hour to form a softener composition. The polyurethane-based polymeric UV light absorber was represented by the aforesaid formula (II), which is a cationic polymeric UV light absorber. The cyclic quaternary ammonium salt of the imidazolinium type was represented by formula (IV):

(IV)

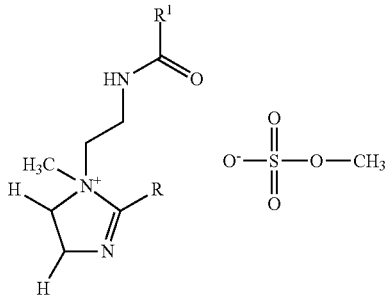

in which each of R and R' was a tallow alkyl group.

At room temperature, a double knitted fabric was soaked in the softener composition solution prepared as described above for 6 minutes, with a little stirring during the soaking. The weight ratio of the fabric to the solution was 1:10. Thereafter, the fabric after being soaked was taken out, and excess solution was removed to make the fabric with a liquid pick up rate of 80% to 150%. The fabric was then placed in an oven at 60° C. for 20 minutes to dry, and then taken out to stand at room temperature for 4 hours to regain moisture, completing the preparation of samples. Thereafter, the ultraviolet protection factors (UPF) of samples were measured using a UV-Visible spectrophotometer UV-2600 (made by SHIMADZU company) at wavelengths of 280 to 400 nm. The test results are reported in Table 1. In addition, the grade and category of various UPF values are shown in Table 2.

EXAMPLE 2

Example 2 is substantially the same as Example 1 with the differences in that the softener composition was prepared to contain 1 wt % of polyurethane-based polymeric UV light absorber (cationic type, represented by formula (II)), 7 wt % of cyclic quaternary ammonium salt of the imidazolinium type (trade name: quaternary ammonium salt-27, commercially available from CHEMOS GmbH), and 92 wt % of deionized water. Furthermore, the double knitted fabric was soaked in the softener composition solution of the present example for 6 minutes. The results of the ultraviolet protection factor (UPF) tests are reported in Table 1.

EXAMPLE 3

Example 3 is substantially the same as Example 1 with the differences in that the softener composition was prepared to contain 10 wt % of polyurethane-based polymeric UV light absorber (cationic type, represented by formula (II)), 6.4 wt % of cyclic quaternary ammonium salt of imidazolinium type (trade name: quaternary ammonium salt-27, commercially available from CHEMOS GmbH), and 83.6 wt % of deionized water. Furthermore, the double knitted fabric was soaked in the softener composition solution of the present example for 6 minutes. The results of the ultraviolet protection factor (UPF) tests are reported in Table 1.

EXAMPLE 4

Example 4 is substantially the same as Example 1 with the differences in that the softener composition was prepared to contain 50 wt % of polyurethane-based polymeric UV light absorber (cationic type, represented by formula (II)), 3.5 wt % of cyclic quaternary ammonium salt of the imidazolinium type (trade name: quaternary ammonium salt-27, commercially available from CHEMOS GmbH), and 46.5 wt % of deionized water. Furthermore, the double knitted fabric was soaked in the softener composition solution of the present example for 6 minutes. The results of the ultraviolet protection factor (UPF) tests are reported in Table 1.

EXAMPLE 5

In an environment of about 50° C., a mixed solution containing 0.1 wt % of polyurethane-based polymeric UV light absorber, 7.1 wt % of cyclic quaternary ammonium salt of the imidazolinium type (trade name: quaternary ammonium salt-27, commercially available from CHEMOS GmbH), and 92.8 wt % of deionized water was sufficiently stirred for 1 hour to prepare a softener composition. The polyurethane-based polymeric UV light absorber was represented by the aforesaid formula (III), which is a nonionic polymeric UV light absorber; the cyclic quaternary ammonium salt of the imidazolinium type was represented by formula (IV):

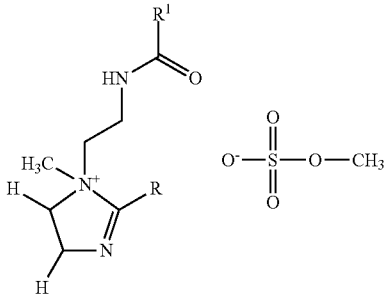

in which each of R and R' was a tallow alkyl group.

At room temperature, a double knitted fabric was soaked in the softener composition solution prepared as described above for 6 minutes, with a little stirring during the soaking. The weight ratio of the fabric to the solution was 1:10. Thereafter, the fabric after being soaked was taken out, and excess solution was removed to make the fabric with a liquid entrainment rate of 80% to 150%. The fabric was placed in an oven at 60° C. for 20 minutes to dry, and then taken out to stand at room temperature for 4 hours to regain moisture, completing the preparation of samples. Then, the ultraviolet protection factors (UPF) of samples were measured using a UV-Visible spectrophotometer UV-2600 (made by SHIMADZU company) at wavelengths of 280 to 400 nm. The test results are reported in Table 1. In addition, the grade and category of various UPF values are reported in Table 2.

EXAMPLE 6

Example 6 is substantially the same as Example 5 with the differences in that the softener composition was prepared to contain 1 wt % of polyurethane-based polymeric UV light absorber (nonionic type, represented by formula (III)), 7 wt % of cyclic quaternary ammonium salt of the imidazolinium type (trade name: quaternary ammonium salt-27, commercially available from CHEMOS GmbH), and 92 wt % of deionized water. Furthermore, the double knitted fabric was soaked in the softener composition solution of the present example for 6 minutes. The results of the ultraviolet protection factor (UPF) tests are reported in Table 1.

EXAMPLE 7

Example 7 is substantially the same as Example 5 with the differences in that the softener composition was prepared to contain 10 wt % of polyurethane-based polymeric UV light absorber (nonionic type, represented by formula (III)), 6.4 wt % of cyclic quaternary ammonium salt of imidazolinium type (trade name: quaternary ammonium salt-27, commercially available from CHEMOS GmbH), and 83.6 wt % of deionized water. Furthermore, the double knitted fabric was soaked in the softener composition solution of the present example for 6 minutes. The results of the ultraviolet protection factor (UPF) tests are reported in Table 1.

EXAMPLE 8

Example 8 is substantially the same as Example 5 with the differences in that the softener composition was prepared to contain 50 wt % of polyurethane-based polymeric UV light absorber (nonionic type, represented by formula (III)), 3.5 wt % of cyclic quaternary ammonium salt of the imidazolinium type (trade name: quaternary ammonium salt-27, commercially available from CHEMOS GmbH), and 46.5 wt % of deionized water. Furthermore, the double knitted fabric was soaked in the softener composition solution of the present example for 6 minutes. The results of the ultraviolet protection factor (UPF) tests are reported in Table 1.

COMPARATIVE EXAMPLE 1

Comparative Example 1 is substantially the same as Example 1 with the differences in that the softener composition did not contain any UV light absorber but just contained 7.1 wt % of cyclic quaternary ammonium salt of the imidazolinium type (trade name: quaternary ammonium salt-27, commercially available from CHEMOS GmbH) and 92.9 wt % of deionized water. The double knitted fabric was soaked in the softener composition solution of the present comparative example for 6 minutes. The results of the ultraviolet protection factor (UPF) tests are reported in Table 1.

COMPARATIVE EXAMPLE 2

Comparative Example 2 is substantially the same as Example 1 with the differences in that the softener composition contained the small molecular UV light absorber Tinuvin-571 (represented by the following formula, commercially available from Taiwan Everlight Chemical Industrial Corporation) instead of the polyurethane-based polymeric UV light absorber. In addition, the softener composition contained 1 wt % of Tinuvin-571, 7 wt % of cyclic quaternary ammonium salt of the imidazolinium type (trade name: quaternary ammonium salt-27, commercially available from CHEMOS GmbH) and 92 wt % of deionized water. The double knitted fabric was soaked in the softener composition solution of the present comparative example for 6 minutes. The results of the ultraviolet protection factor (UPF) tests are reported in Table 1.

Tinuvin-571

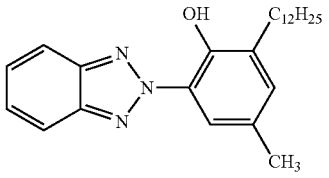

TABLE 1

| | UV light absorber Type | | | | |
|---|---|---|---|---|---|
| | Cationic Formula (II) (wt %) | Nonionic Formula (III) (wt %) | Tinuvin-571 (wt %) | UPF Values | UPF Grade |
| Ex. 1 | 0.1 | — | — | 55 | A |
| Ex. 2 | 1 | — | — | 72 | A |
| Ex. 3 | 10 | — | — | 737 | A |
| Ex. 4 | 50 | — | — | 2346 | A |
| Ex. 5 | — | 0.1 | — | 47 | A |
| Ex. 6 | — | 1 | — | 91 | A |
| Ex. 7 | — | 10 | — | 449 | A |
| Ex. 8 | — | 50 | — | 1249 | A |
| Comp. Ex. 1 | — | — | — | 18 | C |
| Comp. Ex. 2 | — | — | 1 | 33 | B |

TABLE 2

| UPF | Grade | Category |
|---|---|---|
| 40-50, 50+ | A | Excellent |
| 25-39 | B | Very good |
| 15-24 | C | Good |

In view of the results of the UV protection (UPF) tests of the examples and the comparative examples, it can be seen that when the double knitted fabrics were rinsed with the softener composition provided in the present invention, each of the fabrics could possess an excellent ultraviolet light protection effect. Even though the softener compositions contained merely 0.1 wt % of the polyurethane-based polymeric UV light absorber (cationic or nonionic type), the resultant UPFs had reached to about 50 and all the fabrics exhibited very good UV light absorption effect. As the concentration of the polyurethane-based polymeric UV light absorber in the softener composition increased, the exhibited UPFs increased. In contrast to the examples, in the comparative example 1, the double knitted fabric was rinsed with the softener without any addition of UV light absorber. The resultant fabric merely exhibited an ultraviolet protection factor of 18. Furthermore, in the comparative example 2, even when a small molecular UV light absorber was added, the resultant ultraviolet protection factor is still merely 33. Accordingly, the softener composition provided by the present invention can give fabrics an excellent anti-ultraviolet light function.

Although the present invention has been explained in relation to its preferred embodiment, it is to be understood that many other possible modifications and variations can be made without departing from the spirit and scope of the invention as hereinafter claimed.

What is claimed is:

1. A softener composition, comprising:

(A) 0.05 to 50 wt % of polyurethane-based polymeric UV light absorber;

(B) 2 to 15 wt % of cationic softener; and (C) 35 to 97 wt % of water wherein the polyurethane-based polymeric UV light absorber is represented by formula (I):

(I)

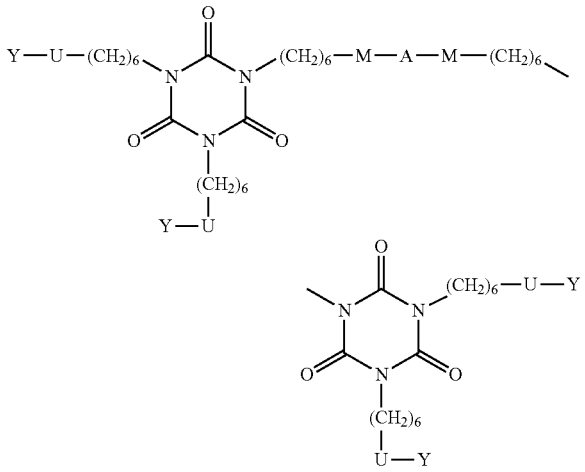

wherein A is selected from the group consisting of the following:

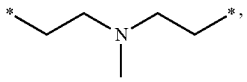

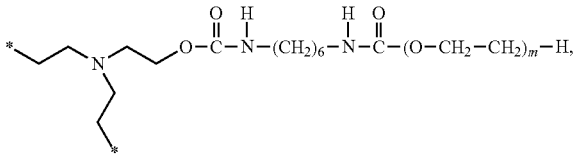

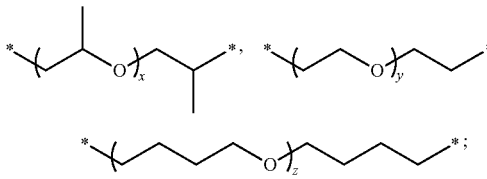

wherein, x is an integer of 15 to 20, y is an integer of 20 to 50, and z is an integer of 10 to 15, m is an integer of 15 to 20, and * is a site for bonding to M;

each of M and U is —NHCOO; and

Y is selected from the group consisting of the following:

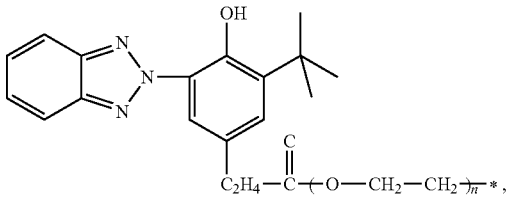

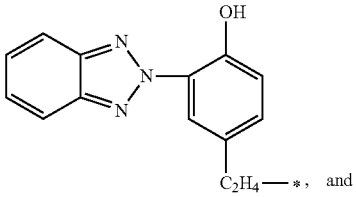

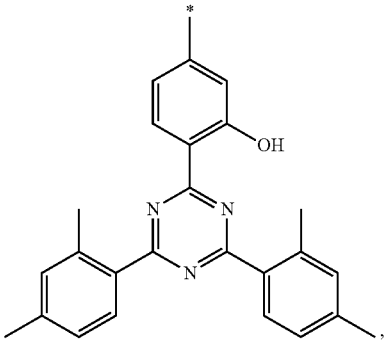

wherein n is an integer of 5 to 10.

2. The softener composition as claimed in claim 1, wherein Y in the polyurethane-based polymeric UV light absorber is represented by the following:

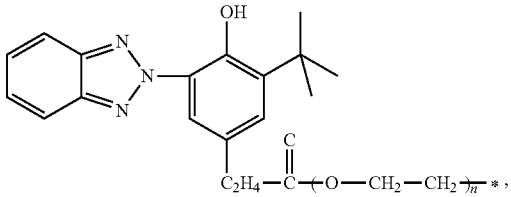

wherein n is an integer of 5 to 10.

3. The softener composition as claimed in claim 2, wherein A in the polyurethane-based polymeric UV light absorber is

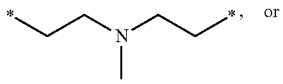

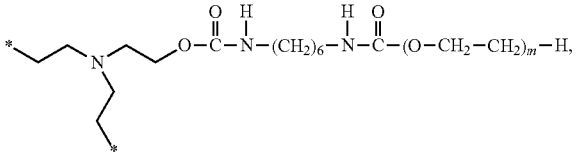

wherein m is an integer of 15 to 20.

4. The softener composition as claimed in claim 2, wherein A in the polyurethane-based polymeric UV light absorber is

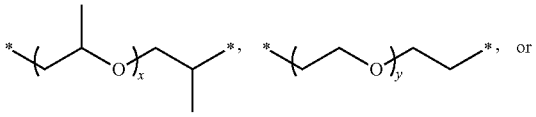

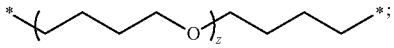

wherein, x is an integer of 15 to 20, y is an integer of 20 to 50, and z is an integer of 10 to 15.

5. The softener composition as claimed in claim 1, wherein the polyurethane-based polymeric UV light absorber is represented by formula (II):

(II)
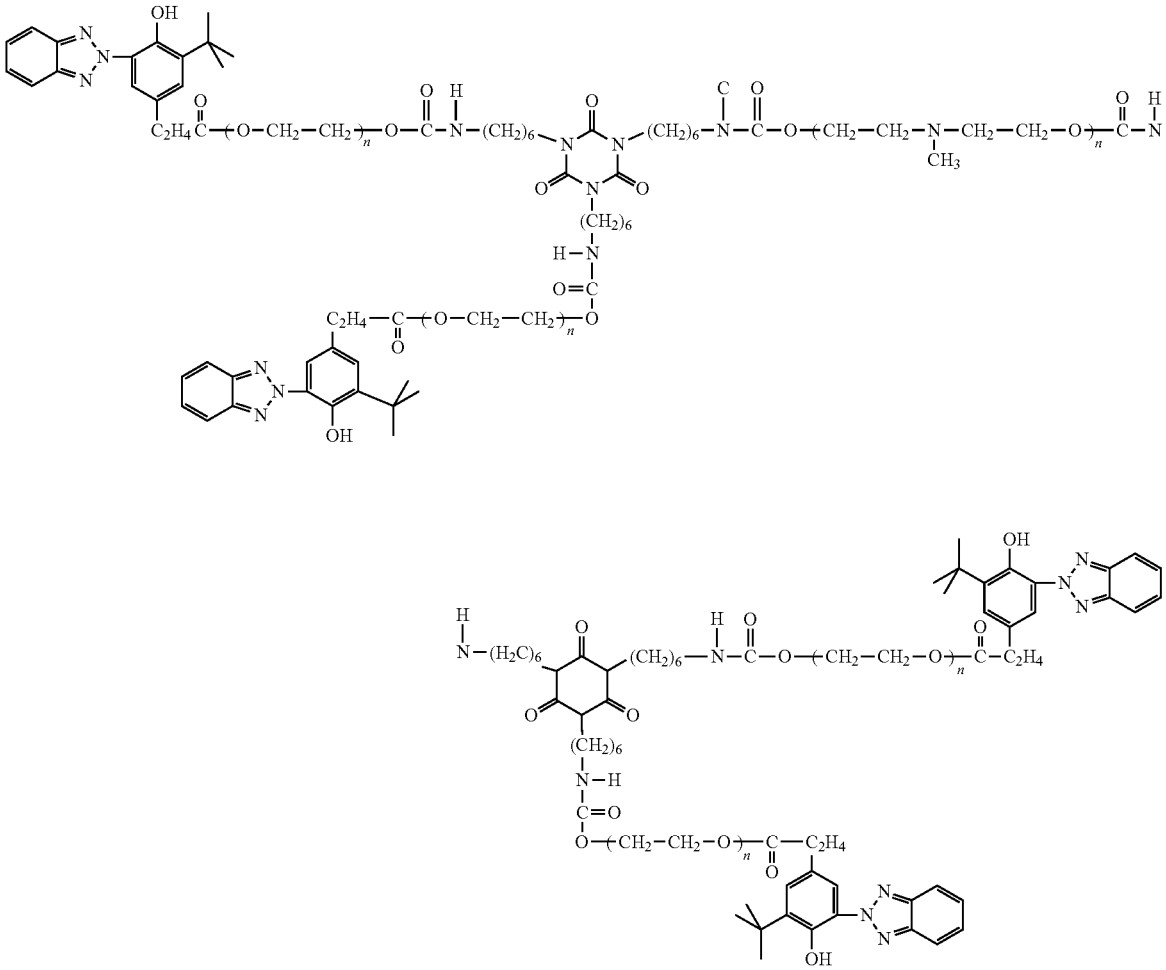
wherein n is an integer of 5 to 10.
6. The softener composition as claimed in claim 1, wherein the polyurethane-based polymeric UV light absorber is represented by formula (III):
(III)
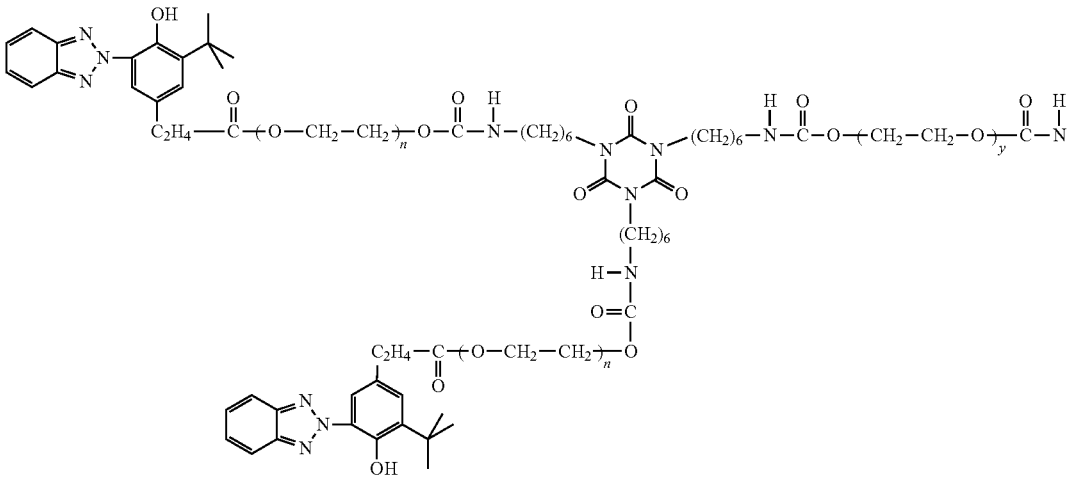

-continued

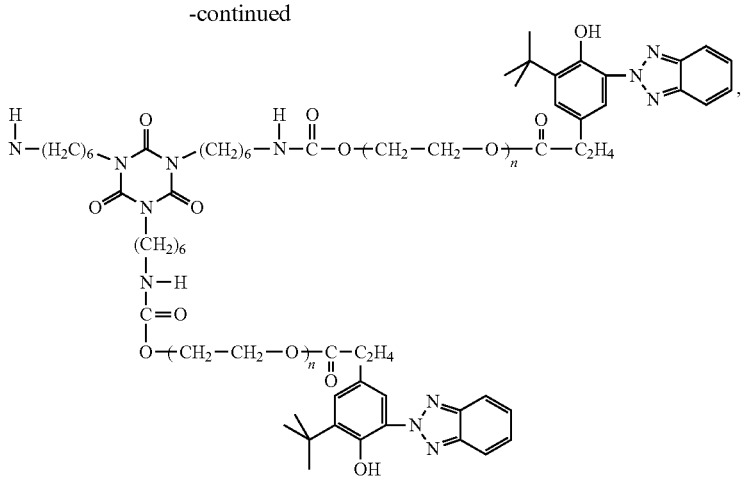

wherein, n is an integer of 5 to 10, and y is an integer of 20 to 50.

7. The softener composition as claimed in claim 1, wherein the cationic softener comprises at least a quaternary ammonium salt compound.

8. The softener composition as claimed in claim 7, wherein the quaternary ammonium salt compound is selected from the group consisting of cationic quaternary ammonium salts, cyclic quaternary ammonium salts of the imidazolinium type, diamido quaternary ammonium salts, biodegradable quaternary ammonium salts, and a combination thereof.

9. The softener composition as claimed in claim 8, wherein the cationic softener is a cyclic quaternary ammonium salt of the imidazolinium type.

10. The softener composition as claimed in claim 9, wherein the cyclic quaternary ammonium salt of the imidazolinium type is represented by formula (IV):

(IV)

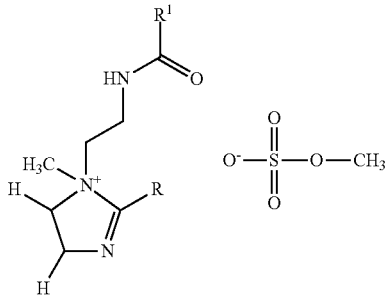

wherein each of R and R' is a tallow alkyl group.

11. The softener composition as claimed in claim 1, further comprising at least an additive selected from the group consisting of perfume, dyes, bactericide, emulsifiers, and whiteners.

* * * * *